US009596939B1

(12) United States Patent
Helman

(10) Patent No.: US 9,596,939 B1
(45) Date of Patent: Mar. 21, 2017

(54) COLLAPSIBLE CHAIR

(71) Applicant: AT THE HELM LLC, Seattle, WA (US)

(72) Inventor: Jonathan Helman, Seattle, WA (US)

(73) Assignee: AT THE HELM LLC, Seattle, WA (US)

( * ) Notice: Subject to any disclaimer, the term of this patent is extended or adjusted under 35 U.S.C. 154(b) by 0 days.

(21) Appl. No.: 14/664,120

(22) Filed: Mar. 20, 2015

Related U.S. Application Data

(60) Provisional application No. 61/968,266, filed on Mar. 20, 2014.

(51) Int. Cl.
*A45F 3/00* (2006.01)
*A47C 4/52* (2006.01)
*A45F 4/02* (2006.01)

(52) U.S. Cl.
CPC ..... *A47C 4/52* (2013.01); *A45F 4/02* (2013.01); *A45F 2004/026* (2013.01)

(58) Field of Classification Search
CPC ..... A45C 3/06; A45C 13/023; A45C 15/00; A45C 3/00; A45C 15/04
USPC ..... 150/100, 106; 224/155, 153, 148; 297/217.1, 188.2, 188.06, 188.12; 190/8, 190/1
See application file for complete search history.

(56) References Cited

U.S. PATENT DOCUMENTS 1,140,997 A * 5/1915 Varanakis ..... A45C 9/00 190/8
4,720,029 A * 1/1988 Varanakis ..... A01M 31/02 224/153
5,374,073 A * 12/1994 Hung-Hsin ..... A45C 5/14 16/113.1
5,507,508 A * 4/1996 Liang ..... A45C 5/14 190/18 A
5,819,999 A * 10/1998 Tennant ..... A45F 4/02 224/153
6,241,313 B1 * 6/2001 Lenz ..... A47D 1/10 297/188.06
6,471,019 B1 * 10/2002 Miller ..... A45C 15/00 190/10
7,213,692 B2 * 5/2007 Wang ..... A45C 9/00 190/8

* cited by examiner

*Primary Examiner* — Fenn Mathew
*Assistant Examiner* — Cynthia Collado
(74) *Attorney, Agent, or Firm* — AEON Law; Adam L. K. Philipp

(57) ABSTRACT

A collapsible chair which may be attached to luggage, used by itself, or configured as a backpack or a handbag.

12 Claims, 14 Drawing Sheets

COLLAPSIBLE CHAIR

CROSS-REFERENCE TO RELATED APPLICATIONS

This application claims the benefit of priority to U.S. Provisional Patent Application No. 61/968,266; filed May 20, 2014; titled Collapsible Child Travel Chair; and naming inventor Jonathan Helman. The above-cited application is hereby incorporated by reference, in its entirety, for all purposes.

FIELD

This disclosure is directed to collapsible chairs.

BACKGROUND

Kids and travel introduce a whole new level of responsibility, stressors and unexpected chaos that can turn the start of an awesome vacation upside down. There are many single purpose travel products that help alleviate these stressors. While a stroller or car seat transporter are an option, they serve as examples of a single purpose item that needs to be pushed, checked at the gate or stored in another bag.

Tracking personal belongings and children requires greater organization and time management. Navigating extra gear and children from a car, train or shuttle, through a crowded airport in order to make a flight on time can be overwhelming. Kids are often seen being carried or holding the hand of an adult to help transport them quickly and ensure their safety. Having to stop numerous times to adjust gear, regain bearings, chase down a child in a fast moving crowd or address unexpected situations can significantly delay the process of getting from point A to B.

DESCRIPTION

Figure 1:
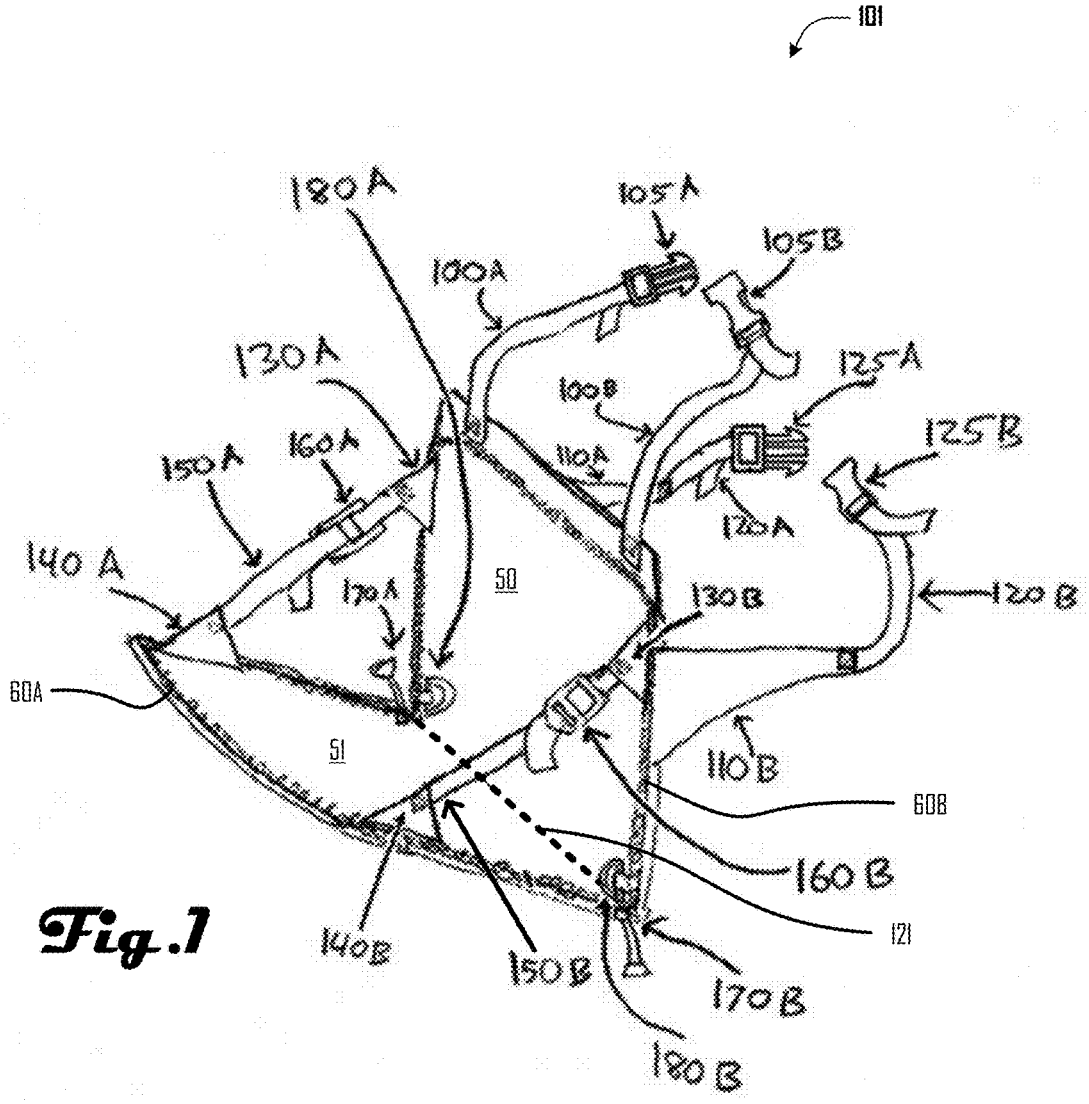
FIG. 1 illustrates a collapsible chair in accordance with one embodiment.

The phrases "in one embodiment", "in various embodiments", "in some embodiments", and the like are used repeatedly. Such phrases do not necessarily refer to the same embodiment. The terms "comprising", "having", and "including" are synonymous, unless the context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Today's on-the-go family requires a compact, multipurpose Collapsible Chair that enables traveling with children to be convenient and assist with the increased level of activity and varied needs while on a family trip or outing; a travel accessory that, when not in use, takes up little space. Collapsible Chair is versatile and convenient when in use, and rolls up easily to store. One of Collapsible Chair's uses is as a travel seat. However, Collapsible Chair is versatile and may also be used, with or without attachment to luggage, as a chair for a sporting event, for camping, for going to the beach, as a reading chair, as a travel bag, as a backpack, as a sitting pad or as a shopping cart seat cover.

One of Collapsible Chair's functions is to transport a child while sitting on a collapsible seat that attaches to the front of a rolling suitcase/bag/luggage/travel bag, or the like. Once the system is securely strapped/wrapped/hooked to the rolling suitcase, and the adult engages the rolling suitcase/travel bag handle, the child can comfortably sit in a form fitting Collapsible Chair to be transported. The versatility of Collapsible Chair also allows for it to be converted into a hanging bag, if still attached to the rolling suitcase or, once removed, as a hand bag, backpack, comfortable chair, shopping cart chair cover for the child. When Collapsible Chair is not in use, it may be desirable to remove it from the bag where it can be folded or rolled and conveniently packed out of the way.

Collapsible Chair will allow adults with children to move with ease across lengthy distances, knowing the child is securely seated on their rolling luggage bag at all times. Collapsible Chair reduces the burden of an adult having to carry a child in their arms and adds an element of adventure as the child is wheeled about without hassle.

Collapsible Chair, when collapsed, zips flat against the front of the rolling bag, without the need to be removed in order to fit into the overhead bin on an airplane. When Collapsible Chair is not in use it can collapse and zip up on both sides serving as a bag hanging from the suitcase to conveniently store an iPad, Kindle, magazines, books or other personal belongings. It can also be removed and converted into a child's pack to carry special blankets, stuffed animals, books, or other items that can be carried by a child. When Collapsible Chair is removed from the bag, it can be rolled or folded into a compact size, roughly the size of a typical newspaper to be stowed away in a luggage pocket, backpack, purse, or anywhere convenient.

Base 51 of Collapsible Chair is of sufficient strength to support a child. It may be flexible, rigid, or a combination of both. The flexibility of base 51 of Collapsible Chair secures the child by allowing it to conform to the shape of the child without the need of extra restraining devices. In some embodiments, a child restraint system may be incorporated into Collapsible Chair to help secure a child to the seat or prevent a child from jumping out.

Collapsible Chair will be adjustable to various heights relative to a bag to which it is attached, for the comfort and or safety of the occupant and the parent. The seat angle of Collapsible Chair is also infinitely adjustable to make it more comfortable for a wide range of ages and sizes of children. This adjustability of Collapsible Chair allows it to be used on a variety of shapes and sizes of bags and/or chairs.

Figure 3:
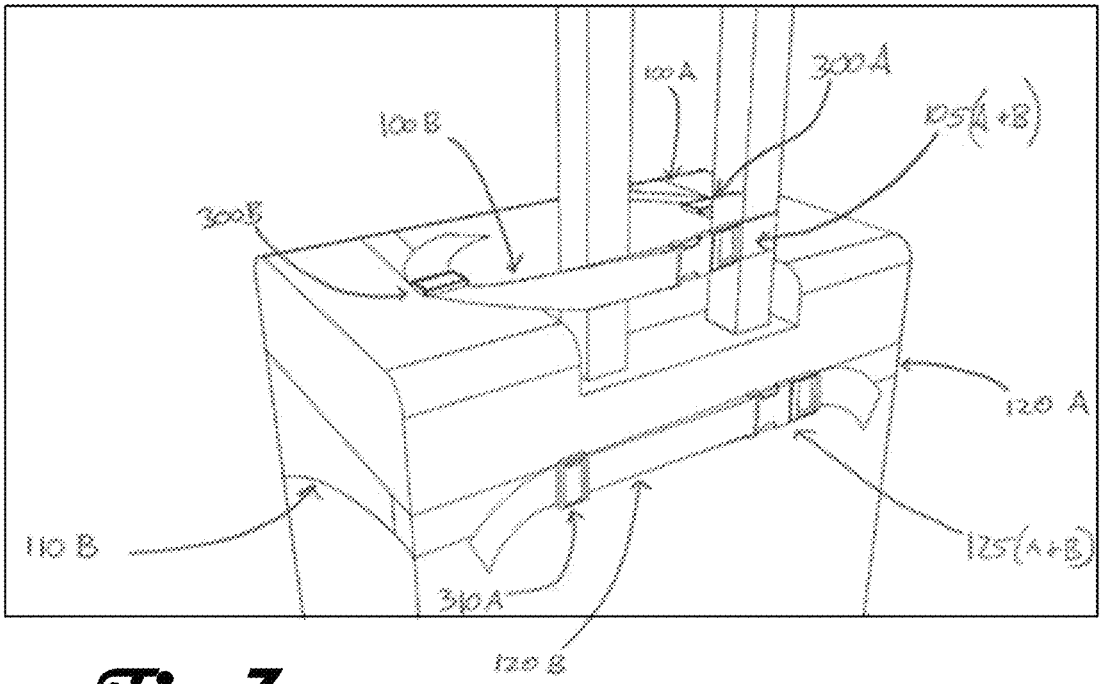
FIG. 3 illustrates an embodiment of components to attach a collapsible chair to a suitcase.
Figure 4:
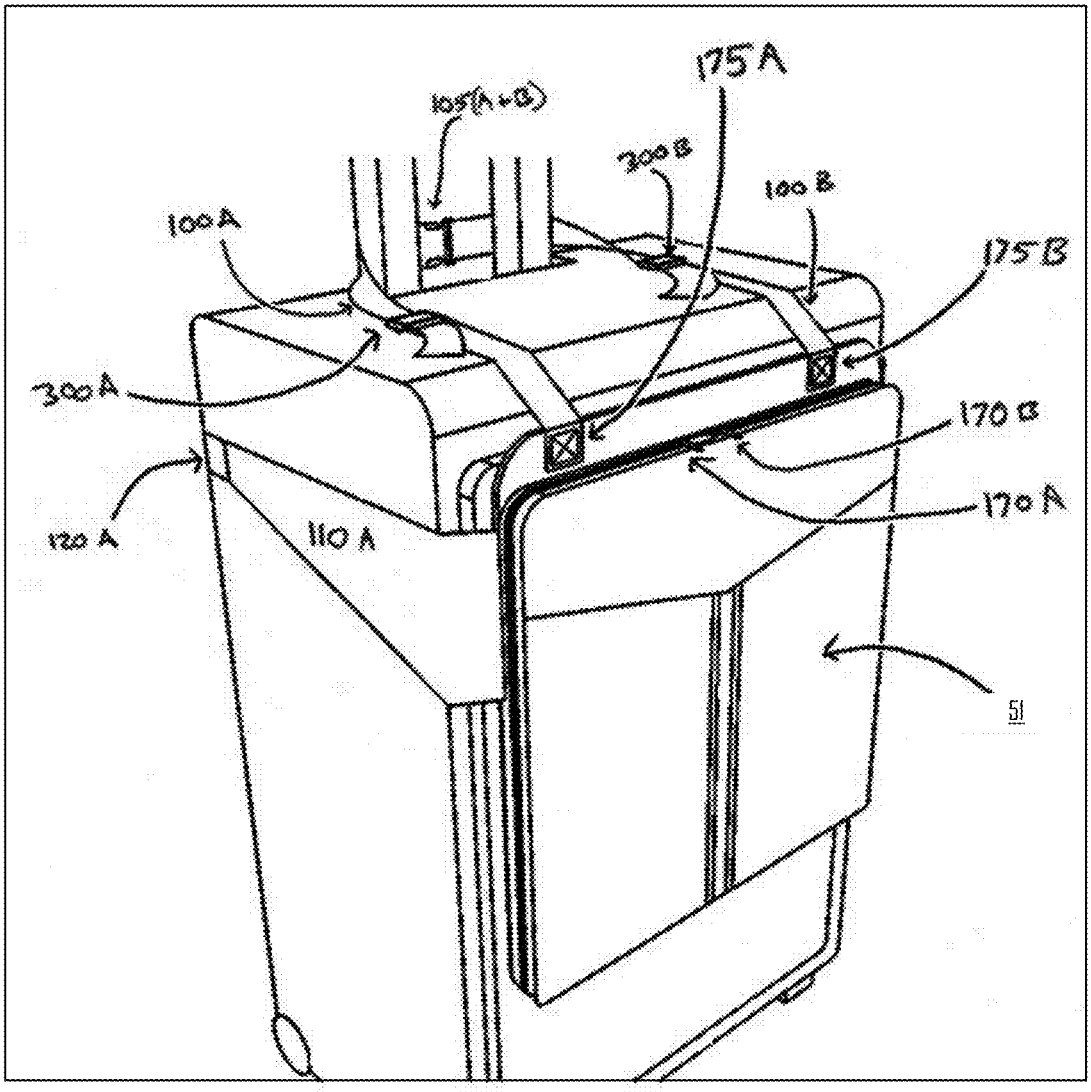
FIG. 4 illustrates a collapsible chair attached to a suitcase in a closed state, in accordance with one embodiment.
Figure 5:
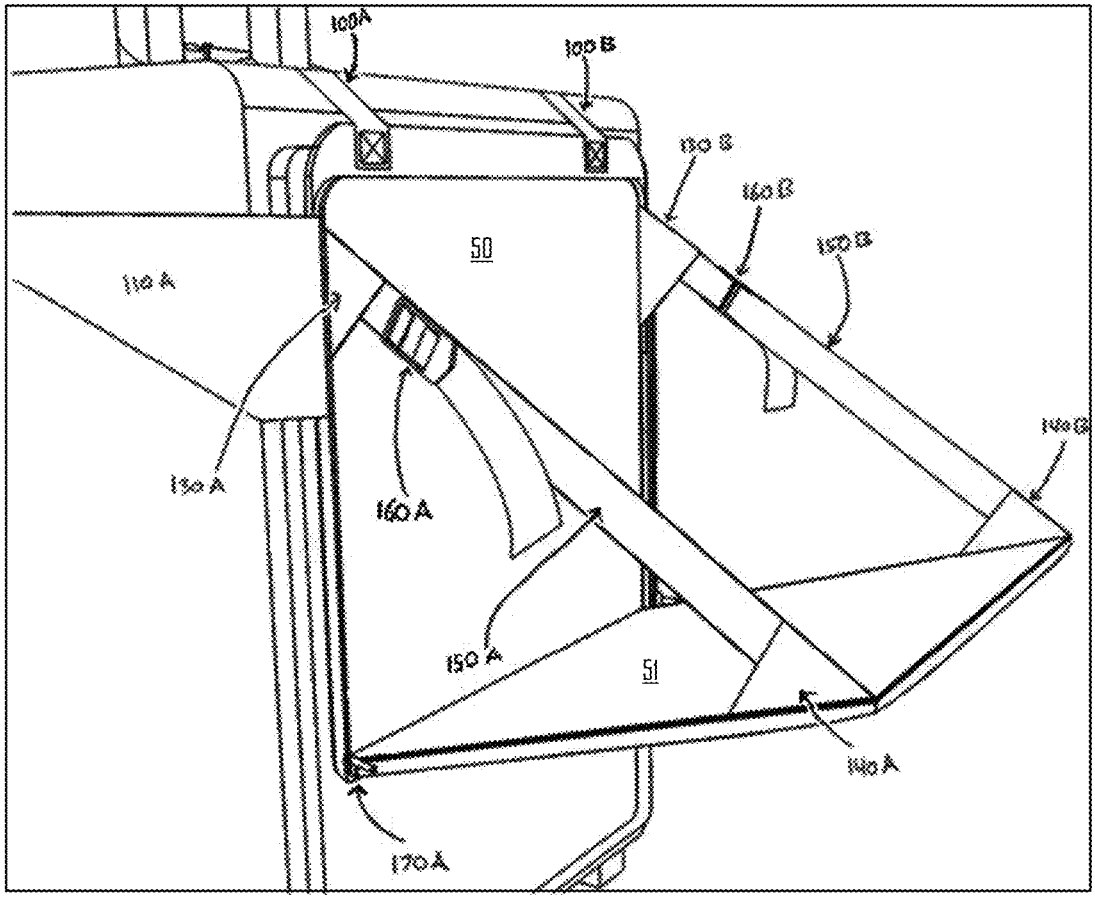
FIG. 5 illustrates a collapsible chair attached to a suitcase in an open state, in accordance with one embodiment.

In an exemplary embodiment, shown in FIG. 1, Collapsible Chair 101 is detachable and includes base 51 for sitting on, back 50 to support base 51, and a mechanism to attach Collapsible Chair to a rolling bag (examples of which are illustrated in FIGS. 3, 4, and 5). Base 51 of Collapsible Chair is of sufficient strength to support a child or other occupant. Base 51 may be made from nylon, leather, canvas, thin rigid material, or the like. It has enough rigidity and/or tensile strength in the base to support and conform to the shape of a child, acting as a means to ensure the child fits in snug and safe.

If a flexible material is used for base 51, a solid support piece may be used to add strength. These support pieces may be in the form of stays, as in stays 220A and 220B in FIG. 6, which may be sewn into or otherwise attached to the fabric, either sandwiched inside the seat material or attached to the outside. It might be desirable to have stays be removable from the product if a parent doesn't feel they are needed, for washing the product, or for more compact storage. Stays may be made of aluminum, fiberglass, wood, plastic, or another sufficiently rigid material. It may be desirable to support stays in such a way that they do not poke holes in the material after repeated use. This may be accomplished by rounding sharp edges of stays, putting end-caps on stays, encasing stays in rip-resistant material, or the like.

It may be desirable to have some padding on Collapsible Chair to make it more comfortable to sit on. This padding may be made of foam, stuffing, plastic, or the like. The padding may serve to cushion the occupant of Collapsible Chair and to give base 51 some extra strength that can help prevent planar deformation of base 51. The padding and/or the stays may also keep the base from accidentally folding on itself and wrinkling, which would make base 51 harder to sit on, and possibly less comfortable.

Back 50 of Collapsible Chair may be made of the same material as base 51 of Collapsible Chair. In embodiments where Collapsible Chair is detachable, as in FIG. 1, back 50 of Collapsible Chair should have enough strength to hold base 51 of Collapsible Chair and to be able to be attached to a bag. Back 50 of Collapsible Chair may also have support stays, as in stays 220C and 220D in FIG. 6, sandwiched inside the material in a similar way that base 51 may be constructed. Back 50 may also have padding similar to base 50. Including such padding would provide benefits including more comfort, greater strength, and added rigidity. Padding would also help comfort the occupant if there is a lump in the bag or if something uncomfortable is poking from the outside of the bag where Collapsible Chair is hanging.

If Collapsible Chair is detachable, as in embodiment illustrated in FIG. 1, it may include a mechanism for attaching Collapsible Chair to the bag. Any mechanism that allows an attached Collapsible Chair to support the weight of a child or other occupant may be sufficient. In the illustrated embodiment, such a mechanism includes straps of material attached to the back of Collapsible Chair. Top strap 100A and 100B goes around the bag in such a way that Collapsible Chair will hang from the bag. Top strap 100A and 100B attaches to the top of the back of Collapsible Chair in two places and forms a loop to go around an attachment point on the bag. With a rolling bag, this point of attachment may be the telescoping handle that rises up from the bag to push or pull it. It may also be possible to hang Collapsible Chair through another type of handle, loop, or the like that is attached to the bag. Top strap 100A and 100B may be made from nylon, leather, canvas, plastic, rubber, or the like. It may include buckle 105A and 105B or other fastening device to allow it to be unhooked easily from the bag when needed. If present, buckle 105A and 105B should grip top strap with sufficient strength to be able to support the weight of Collapsible Chair with an occupant in it. Top strap 100A and 100B may be adjustable in length to accommodate different bag sizes and allow Collapsible Chair to hang from the bag at different heights. The length adjustment may be accomplished by a mechanism built into buckle 105A and 105B, additional pieces on the top strap to help manage strap length, as in adjustors 300A and 300B, or a similar device. Top strap 100A and 100B may be fastened to Collapsible Chair using stitching, rivets, or the like, with sufficient strength to carry the weight of the Collapsible Chair and its occupant.

In the exemplary embodiment, the back of Collapsible Chair also has back strap 120A and 120B to help keep it against the bag. Back strap 120A and 120B goes from one side of the back of Collapsible Chair to the other. Back strap may be of similar construction to top strap. Back strap is fastened to Collapsible Chair with sufficient strength to be able to hold it onto a bag, and is adjustable in length to accommodate bags of different sizes. Like top strap, it has buckles 125A and 125B and strap adjustment slide mechanism 310A of sufficient strength. Back strap may be made from nylon, leather, canvas, plastic, rubber, or the like.

In some embodiments, the back of base 51 and the bottom of back 50 may be attached. This may be accomplished by using buckles, sewing base 51 to back 50, constructing base 51 and back 50 from one piece of material, or the like. In some embodiments, the attachment mechanism between base 51 and back 50 may be able to fold at various angles to adjust and/or close Collapsible Chair. In the embodiment illustrated in, for example, FIGS. 1 and 5, this mechanism is a pair of adjustment straps, right adjustment strap 150A and left adjustment strap 150B, that are adjustable in length and sufficiently strong to hold base 51 of Collapsible Chair at the desired angle with the occupant in it. Adjustment straps 150A and 150B may be similar to top and side straps on Collapsible Chair, and may be made from nylon, leather, canvas, plastic, rubber, or the like. In the illustrated embodiment, two adjustment straps 150A and 150B are fastened at an angle between the top of back 50 and the front of base 51, each adjustment strap with an adjustment mechanism 160A and 160B. Adjustment straps 150A and 150B may attach to Collapsible Chair with stitching, rivets, or the like.

It may be desirable to fasten Collapsible Chair closed when not in use. In the illustrated embodiment, rows of zipper teeth are stitched along the outer edges of base 51 and back 50. Two zipper sliders 170A and 170B with attached zipper pulls allow Collapsible Chair to be left entirely open, zipped entirely closed, or opened as much as needed to allow Collapsible Chair to be used as a storage pouch, pocket, backpack, handback, and the like when unoccupied. Other mechanisms may also be used to fasten Collapsible Chair shut, such as other zipper configurations, snaps, buckles, hook & loop fasteners, or the like. Any such mechanism preferably would be easy to operate and comfortable for an occupant of Collapsible Chair. In some embodiments when Collapsible Chair is fastened closed, certain parts of Collapsible Chair are hidden from view. For example, in the embodiment illustrated in FIG. 1, when Collapsible Chair is zipped shut, D-rings 180A and 180B and an angle-varying mechanism, such as top attachment point 130A and 130B, bottom attachment point 140A and 140B, adjustment straps 150A and 150B, and adjustment mechanism 160A and 160B, are concealed within Collapsible Chair for a neater appearance.

FIG. 1 illustrates Collapsible Chair 101 and certain components. Collapsible Chair 101 includes base 51 and back 50 which are attached in the back of base 51 and the bottom of back 50, forming hinge 121, which hinge 121 has an axis of rotation. Base 51 and back 50 are supported in the front corners by adjustment straps 150A and 150B on either side. Each strap has its own adjustable mechanism 160A and 160B which allows strap to vary in length to change the angle of Collapsible Chair. Right adjustment strap 150A attaches to base 51 at attachment point 140A and attaches to back 50 at attachment point 130A. Left adjustment strap 150B attaches to base 51 at attachment point 140B and attaches to back 50 at attachment point 130B. Top connection strap comprises left side top strap 100B and right side top strap 100A that connect together with left adjustable buckle 105B and right adjustable buckle 105A. Top connection strap 100A and 100B also have a mechanism for managing strap length (see FIG. 3, adjustors 300A and 300B). Collapsible Chair 101 has left side flap 110B and right side flap 110A that hold it to luggage. It consists of material of sufficient strength, which material starts wide on the chair side and tapers down to the width of the strap distal to the chair. Left side back strap 120B and right side back strap 120A attach to the tapered end of their respective side flaps 110 A and 110B and connect together with adjustable buckle 125A and 125B. FIG. 1 also shows two zipper pulls 170A and 170B that zip around the bag to close it and meet at the top to close Collapsible Chair in an almost flat configuration having two closures 60A, 60B. Closure 60A is positioned along a first perimeter of the base 51 between the first corner of the base 51 distal to the hinge 121, along a second perimeter of the back 50 between the first corner of the back distal to the hinge 121, along a third perimeter of the base 51 between the first corner of the base 51 distal to the hinge 121 to a middle of a side of the base 51 distal to the hinge 121, and along a fourth perimeter of the back 50 between the first corner of the back 50 distal to the hinge 121 to a middle of a side of the back 50 distal to the hinge 121. Closure 60B is positioned along a fifth perimeter of the base 51 between the second corner of the base 51 distal to the hinge 121, along a sixth perimeter of the back 50 between the second corner of the back 50 distal to the hinge 121, along a seventh perimeter of the base 51 between the second corner of the base 51 distal to the hinge 121 to the middle of the side of the base 51 distal to the hinge 121, and along an eighth perimeter of the back 50 between the second corner of the back 50 distal to the hinge 121 to the middle of the side of the back 50 distal to the hinge 121. These closures 60A, 60B may close at least one set of corresponding perimeters of the base 51 and back 50 together. Two D-rings 180A and 180B attach to back 50 of Collapsible Chair for attaching a child restraint system (not shown in FIG. 1).

Figure 2:
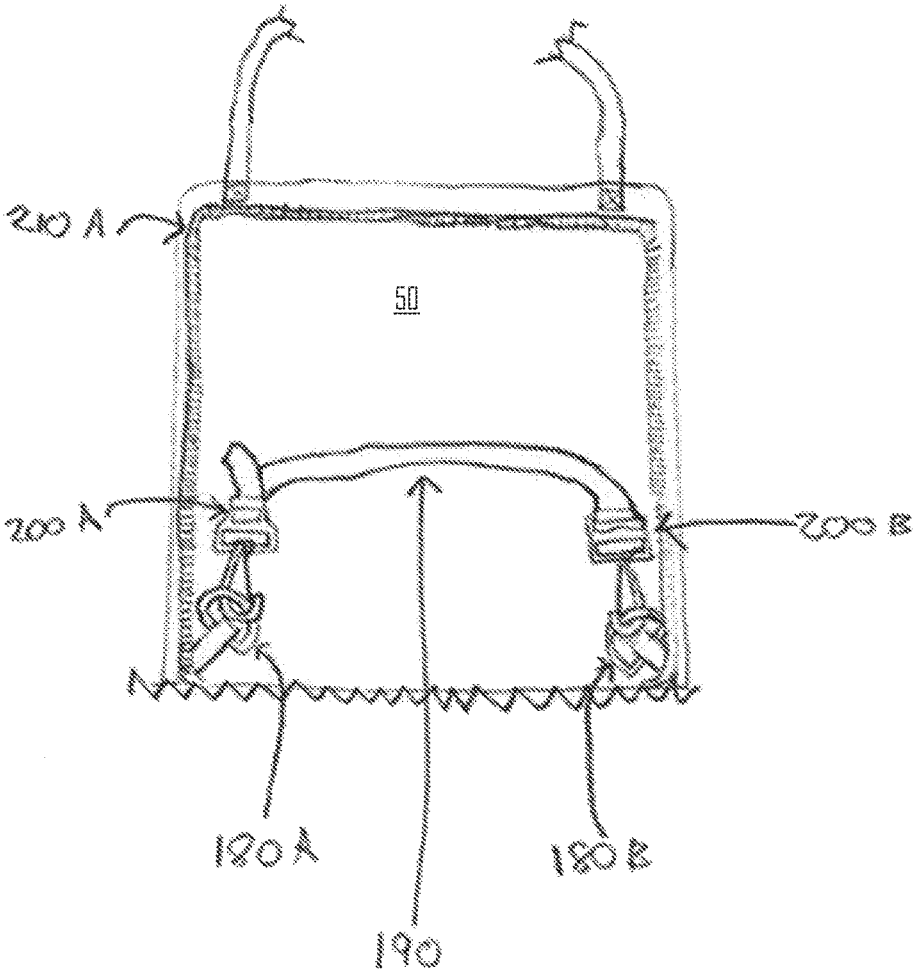
FIG. 2 illustrates a front view of a collapsible chair in accordance with one embodiment.

FIG. 2 shows a cutaway view of the back of an embodiment of Collapsible Chair with a detailed view of a child restraint system, and the top half of zipper 210A that may close Collapsible Chair. The illustrated child restraint system comprises restraint strap 190 with right snap hook 200A that snaps onto right D-ring 180A, and left snap hook 200B that snaps onto left D-ring 180B. One of snap hooks 200A and 200B may be adjustable or have a separate adjustment mechanism (like adjustable mechanism 160A) so that the length of restraint strap 190 can be changed to accommodate different sizes of children or other occupants.

FIG. 3 is a rear view of Collapsible Chair attached to a rolling suitcase. It illustrates where top left strap 100B and top right strap 100A may connect together with left adjustable buckle 105B and right adjustable buckle 105A. Top strap length management is illustrated as comprising adjustor 300B for the top left and adjustor 300A for the top right. Left side flap 110B is shown attached to left side back strap 120B and is shown attached to right side back strap 120A with left adjustable buckle 125B and right adjustable buckle 125A. Left side back strap 120B is also shown with a strap adjustment slide mechanism 310A that manages extra strap length.

FIG. 4 is a front view of Collapsible Chair attached to a rolling suitcase. It is shown zipped closed via left zipper pull 170B and a right zipper pull 170A. The zipper pulls can zip all the way up as shown, or partially (open at the top), to allow Collapsible Chair to act as a pouch to store things. FIG. 4 illustrates the bottom of base 51 when the Collapsible Chair is closed. It shows right side strap 110A as it wraps around the rolling suitcase and is attached to back strap 120A. Left top strap 100B is shown where it attaches to Collapsible Chair at stitching 175B, and right top strap 100A is shown where it attaches to Collapsible Chair at stitching 175A. Both top straps 100A and 100B are shown connecting behind the telescoping handle of the rolling suitcase via adjustable buckle 105A and 105B. The top strap management and adjustors 300A and 300B are also shown.

FIG. 5 is a front view of Collapsible Chair attached to a rolling suitcase. Collapsible Chair is shown in an unzipped position with right zipper 170A shown open all of the way. Collapsible Chair is also shown in detail with back 50 against the suitcase. Collapsible Chair is shown in an open position being supported by the left adjustment strap 150B and right adjustment strap 150A. Left adjustment strap 150B adjusts in length via left adjustment mechanism 160B and attaches to the back of Collapsible Chair at attachment point 130B and the base 51 at attachment point 140B. Right adjustment strap 150A adjusts in length via right adjustment mechanism 160A and attaches to back 50 at attachment point 130A and to base 51 at attachment point 140A. Top left strap 100B and top right 100A strap are shown supporting Collapsible Chair from the top, and right side strap 110A is shown supporting Collapsible Chair on the side.

Figure 6:
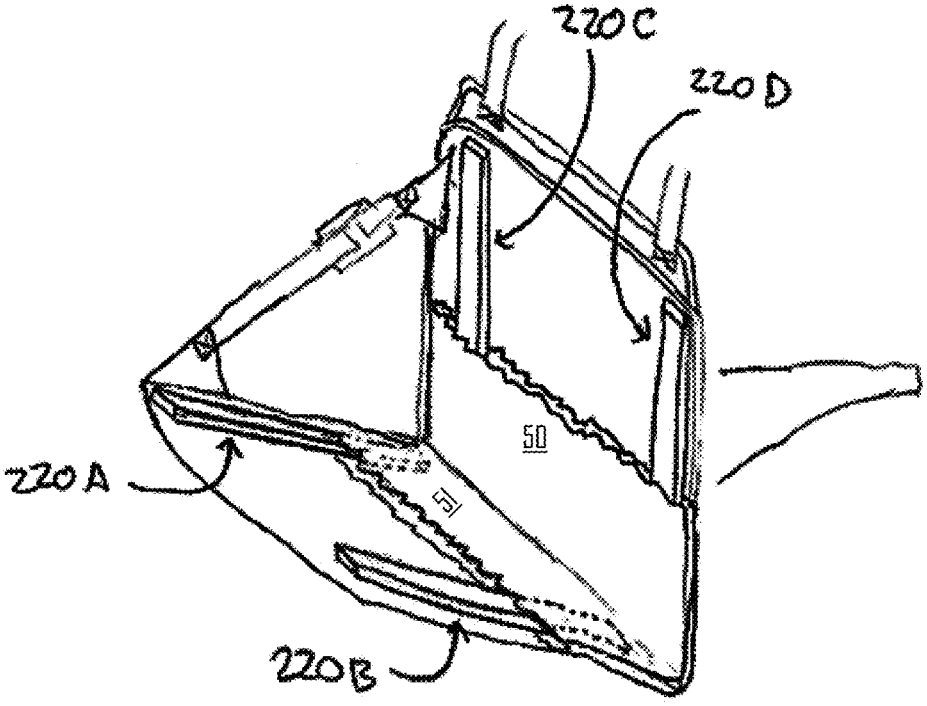
FIG. 6 illustrates embodiments of internal components of a collapsible chair.

FIG. 6 shows Collapsible Chair with the outer material cut away to show the main support material within. Back 50 is shown cut away to reveal a left support piece 220D and right support piece 220C that help stabilize Collapsible Chair. Base 51 is shown cut away to reveal left support piece 220B and right support piece 220A that help stabilize Collapsible Chair.

Figure 7A:
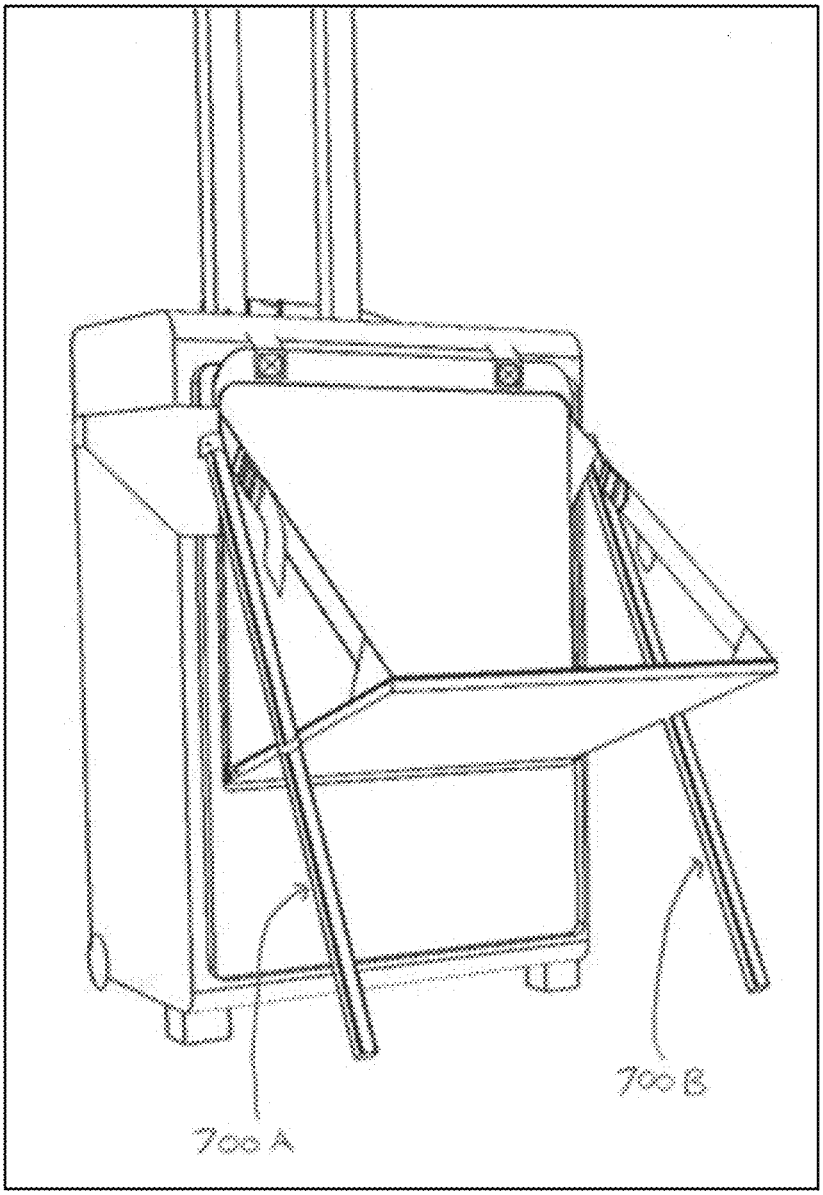
FIG. 7A illustrates an embodiment of a collapsible chair with support legs in an open state.
Figure 7B:
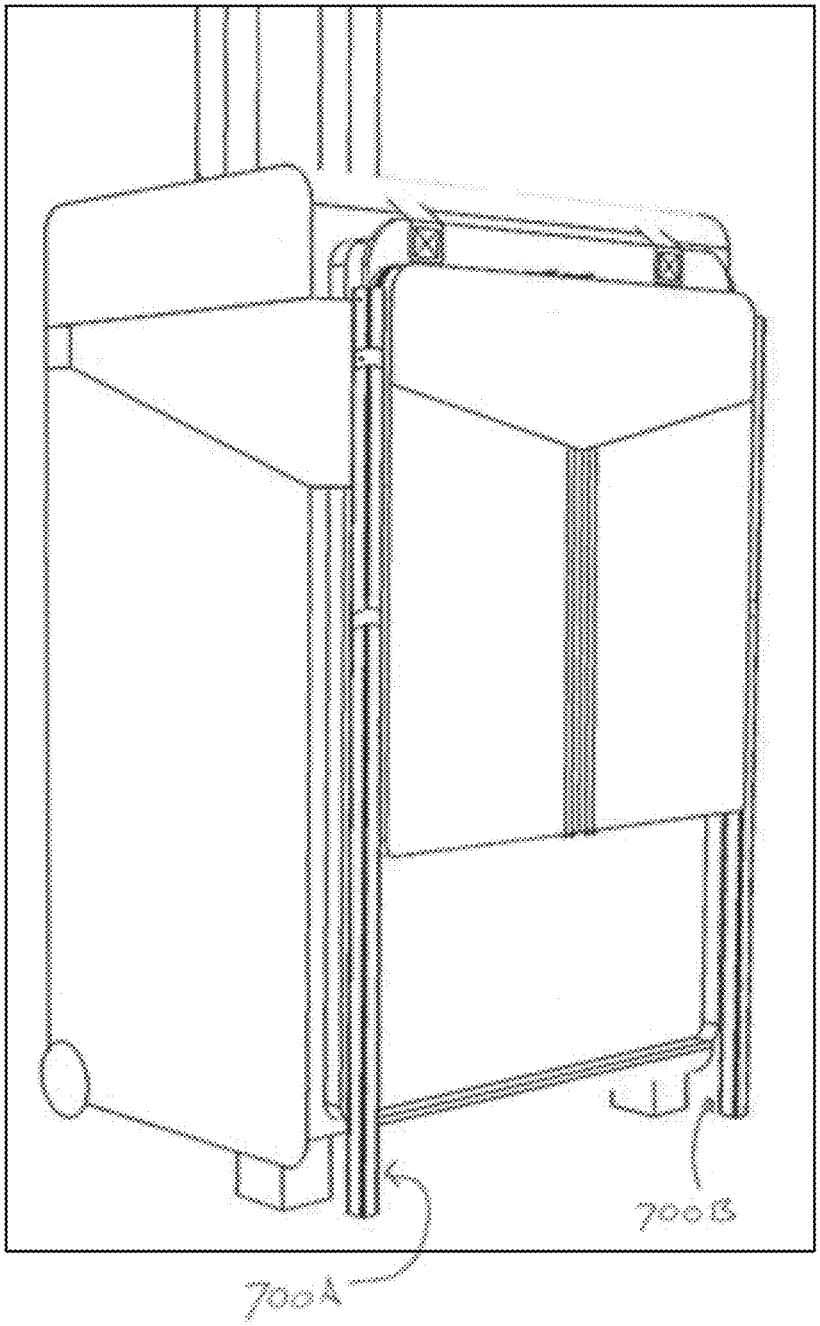
FIG. 7B illustrates an embodiment of a collapsible chair with support legs in a closed state.

FIG. 7A shows an alternative embodiment of Collapsible Chair which supports the rolling suitcase without anyone having to hold the suitcase. This is accomplished with left support leg 700B and right support leg 700A. FIG. 7A illustrates Collapsible Chair open with support legs 700A and 700B in the supporting position. FIG. 7B illustrates Collapsible Chair closed with the legs stowed away in a closed position.

Figure 8:
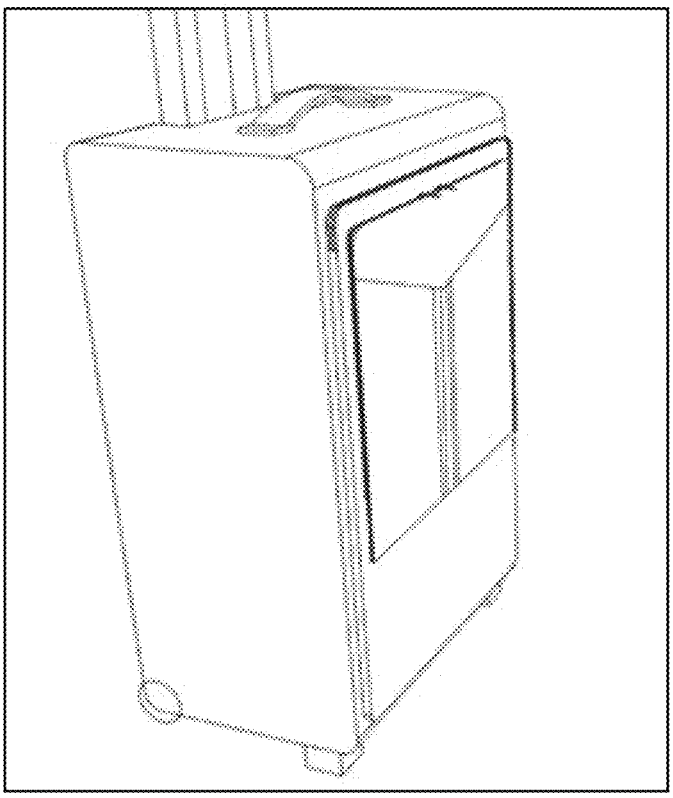
FIG. 8 illustrates an embodiment of a collapsible chair incorporated into a suitcase in a closed state.
Figure 9:
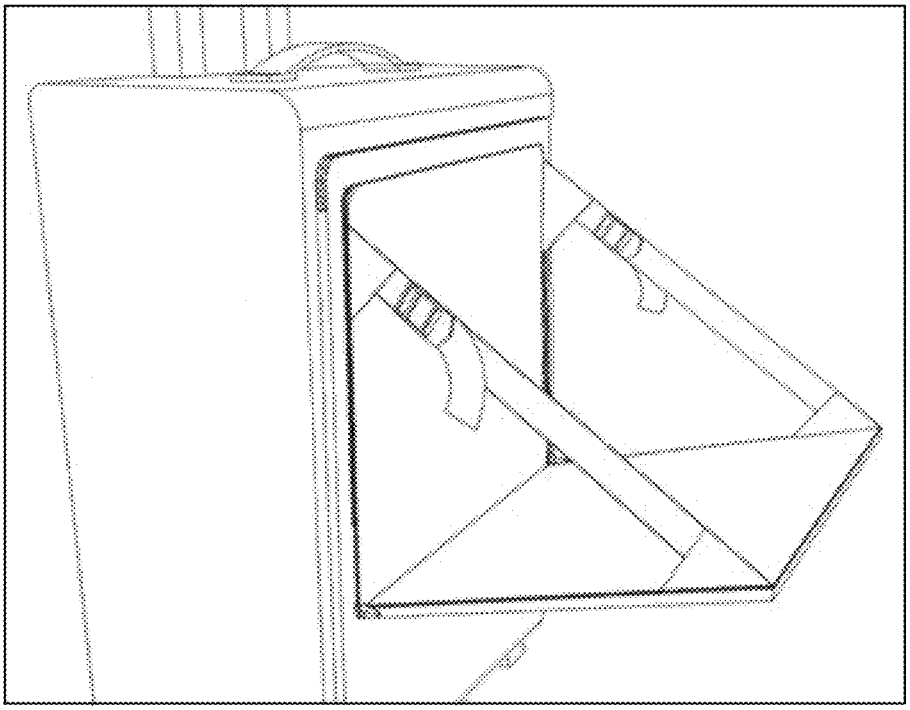
FIG. 9 illustrates an embodiment of a collapsible chair incorporated into a suitcase in an open state.

FIGS. 8 and 9 illustrate an alternative embodiment of Collapsible Chair incorporated into a rolling suitcase. This version is not removable from the suitcase, but incorporates many of the same features. FIG. 8 shows incorporated Collapsible Chair closed where it could act as a normal pocket on the suitcase. FIG. 9 shows incorporated Collapsible Chair open and ready to be sat on. It has the same adjustability as the removable Collapsible Chair.

Figure 10:
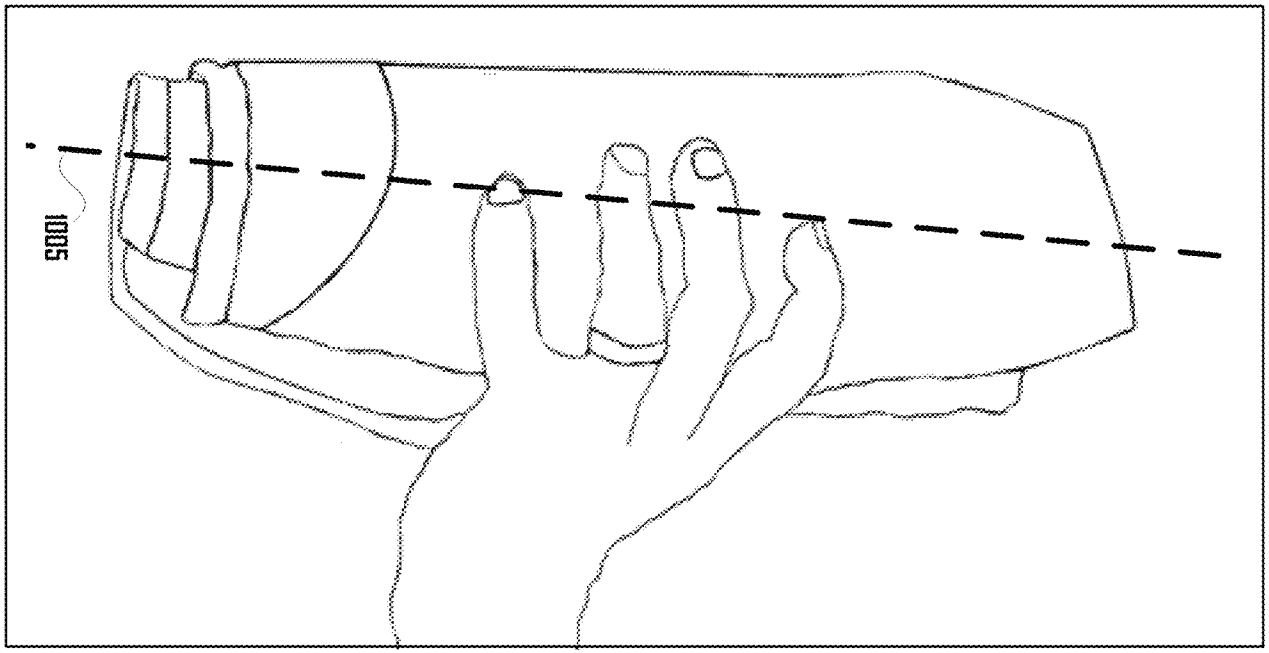
FIG. 10 illustrates an embodiment of a collapsible chair rolled up.
Figure 11:
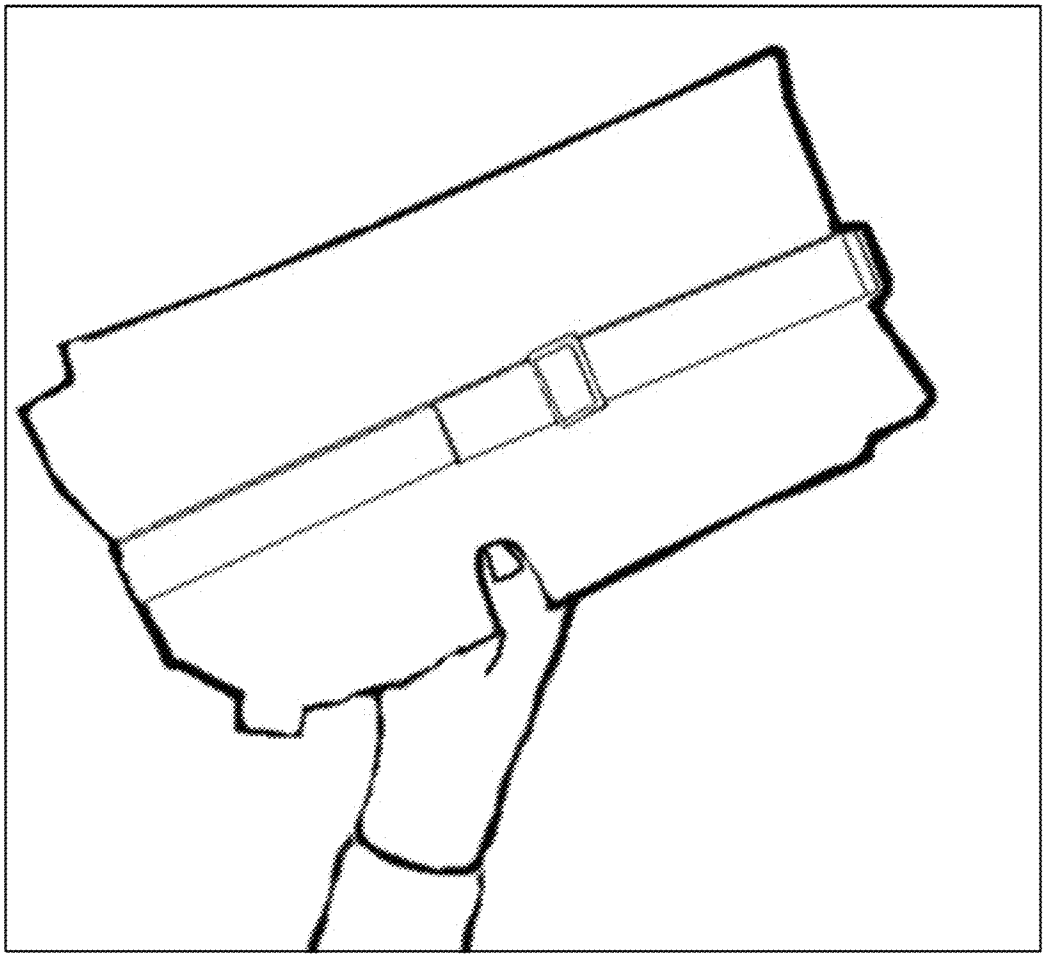
FIG. 11 illustrates an embodiment of a collapsible chair folded in half.

FIGS. 10 and 11 show the compactibility of Collapsible Chair. FIG. 10 shows Collapsible Chair rolled up into a tube like shape. As illustrated Collapsible Chair is rolled up along rolling axis 1005, which rolling axis is perpendicular to the axis of rotation of hinge 121. FIG. 11 shows Collapsible Chair folded in half. These Figures demonstrate the small size Collapsible Chair and that it can be contorted to make it convenient to pack away.

Figure 12:
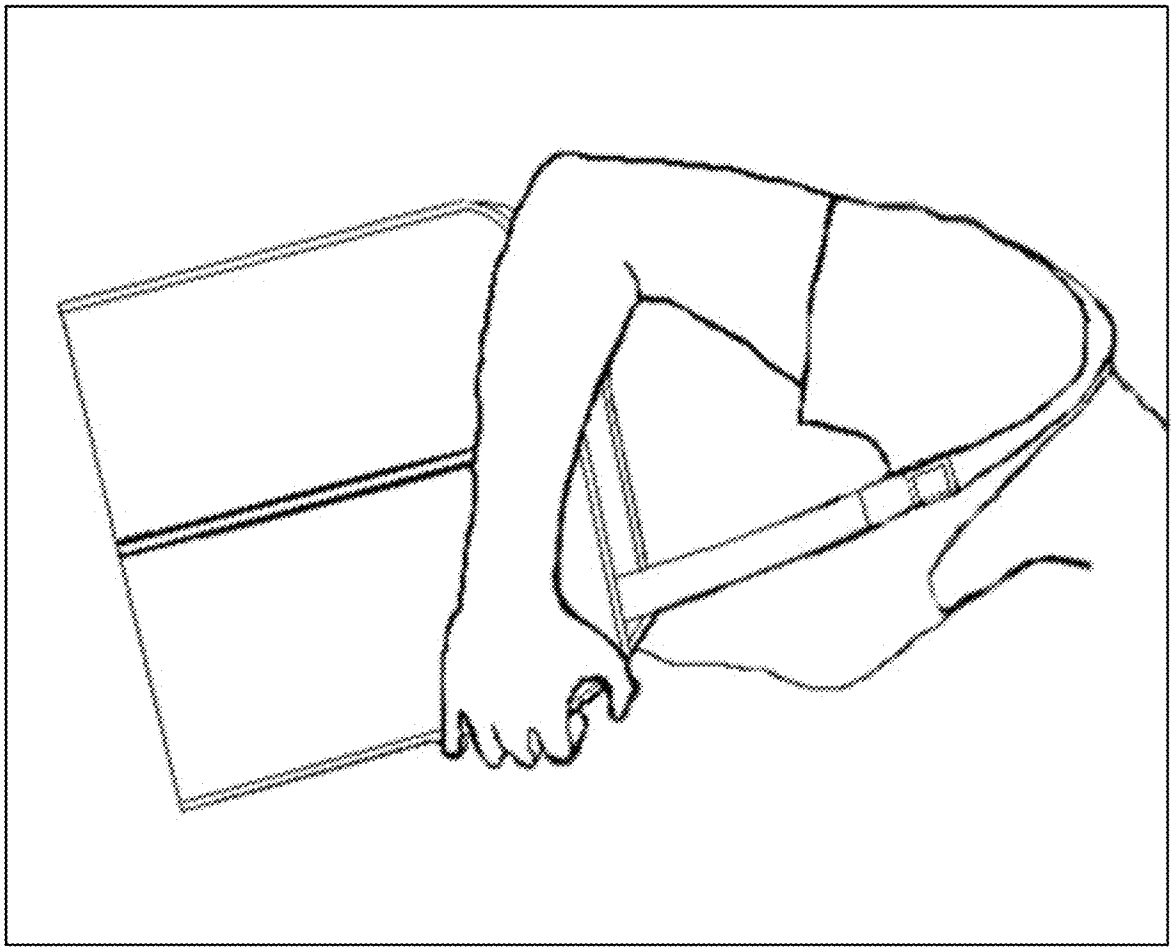
FIG. 12 illustrates an embodiment of a collapsible chair configured to be used as a handbag.

FIG. 12 illustrates an embodiment of Collapsible Chair similar to that of FIG. 1, configured as a handbag which can be conveniently carried by the top strap over the shoulder.

Figure 13:
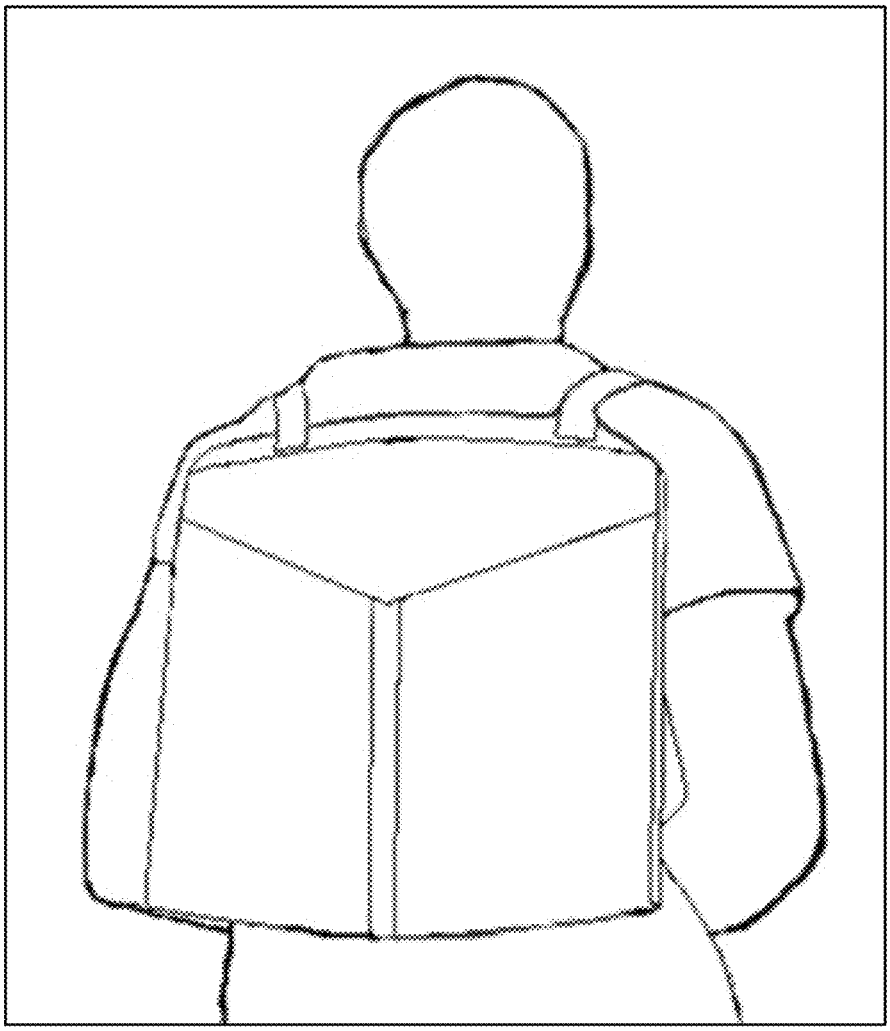
FIG. 13 illustrates an embodiment of a collapsible chair configured to be worn as a backpack.

FIG. 13 illustrates an embodiment of Collapsible Chair similar to that of FIG. 1, configured so that Collapsible Chair can be worn as a backpack. This can be accomplished by connecting adjustable buckle 105A on top strap to adjustable buckle 125A on side strap and adjustable buckle 105B on top strap to adjustable buckle 125B on side strap. In an alternative embodiment, two more buckles may be added to the bottom of Collapsible Chair to facilitate turning it into a backpack by making the straps more comfortable to wear.

Although specific embodiments have been illustrated and described herein, it will be appreciated by those of ordinary skill in the art that alternate and/or equivalent implementations may be substituted for the specific embodiments shown and described without departing from the scope of the present disclosure. For example, although the description provided above discusses making in association between a single online-referral source and an offline transaction, in other embodiments, similar systems and methods may be employed to associate two or more online-referral sources with a given offline transaction. This application is intended to cover any adaptations or variations of the embodiments discussed herein.

The invention claimed is:

1. A collapsible chair comprising:

a base and a back connected along a hinge, which hinge comprises a central hinge portion, a first and a second hinge end, and a hinge axis of rotation, the base being configured to collapse around an axis perpendicular to the hinge axis of rotation when the collapsible chair is not occupied but strong enough along the hinge axis of rotation to help prevent planar deformation of the base when the collapsible chair is occupied;

a first adjustment strap connected to a first corner of the base distal to the hinge and connected to a first corner of the back distal to the hinge, wherein the first corners of the base and back distal to the hinge are configured to support the base on a first adjustment strap plane perpendicular to the hinge axis of rotation when the collapsible chair is not rolled up;

a second adjustment strap connected to a second corner of the base distal to the axis and connected to a second corner of the back distal to the axis, wherein the second corners of the base and back distal to the hinge are configured to support the base on a second adjustment strap plane perpendicular to the hinge axis of rotation when the collapsible chair is not rolled up and when the first and second adjustment strap planes are parallel;

a top strap comprising a top strap fastening device, which top strap fastening device may be used to releasably attach the collapsible chair to a luggage;

a side strap comprising a side strap fastening device, which side strap may releasably encircle the luggage;

a first closure along a first perimeter of the base between the first corner of the base distal to the hinge and the first hinge end, along a second perimeter of the back between the first corner of the back distal to the hinge and the first hinge end, along a third perimeter of the base between the first corner of the base distal to the hinge to a middle of a side of the base distal to the hinge, and along a fourth perimeter of the back between the first corner of the back distal to the hinge to a middle of a side of the back distal to the hinge; and a second closure along a fifth perimeter of the base between the second corner of the base distal to the hinge and the second hinge end, along a sixth perimeter of the back between the second corner of the back distal to the hinge and the second hinge end, along a seventh perimeter of the base between the second corner of the base distal to the hinge to the middle of the side of the base distal to the hinge, and along an eighth perimeter of the back between the second corner of the back distal to the hinge to the middle of the side of the back distal to the hinge, wherein the first and second closures may close at least one set of corresponding perimeters of the base and back together.

2. The collapsible chair of claim 1, further comprising:

a first rigid stay and a second rigid stay within the base, wherein the first and second rigid stays are perpendicular to the hinge axis of rotation.

3. The collapsible chair of claim 1, wherein the collapsible chair is configured as a backpack.

4. The collapsible chair of claim 1, wherein the base is folded around the axis perpendicular to the hinge axis of rotation so that the collapsible chair is configured to be stowed away in a pocket of the luggage.

5. The collapsible chair of claim 1, wherein the base includes padding configured to help prevent planar deformation of the base when the collapsible chair is occupied and also configured so that the base can collapse around the axis perpendicular to the hinge axis of rotation when the collapsible chair is not occupied and not connected to the luggage.

6. The collapsible chair of claim 1, wherein the base contains rigid stays configured to keep the base from folding on itself and wrinkling when the collapsible chair is occupied and also configured to collapse around the axis perpendicular to the hinge axis of rotation when the collapsible chair is not occupied and not connected to the luggage.

7. The collapsible chair of claim 1, wherein the base contains rigid stays perpendicular to the axis of rotation but does not contain rigid stays along the hinge axis of rotation, the rigid stays perpendicular to the axis of rotation configured to keep the base from folding on itself and wrinkling when the collapsible chair is occupied and also configured so that the base can collapse around the axis perpendicular to the hinge axis of rotation when the collapsible chair is not occupied and not connected to the luggage.

8. The collapsible chair of claim 1, wherein the base is rolled up around the axis perpendicular to the hinge axis of rotation and wherein the collapsible chair is not occupied and not connected to the luggage.

9. The collapsible chair of claim 1, wherein the top strap fastening device releasably attaches the collapsible chair to the luggage, wherein the top strap forms a loop that goes around a telescoping handle, the telescoping handle being an attachment point on the luggage.

10. The collapsible chair of claim 1, wherein the top strap includes a length adjustment mechanism built into a buckle of the top strap whereby the top strap is adjustable in length to accommodate the size of the luggage.

11. The collapsible chair of claim 1, wherein the top strap includes a length adjustment mechanism that includes one or more removable lengthening pieces of the top strap whereby the top strap is adjustable in length to accommodate the size of the luggage.

12. A collapsible chair comprising:

a base and a back connected along a hinge, which hinge comprises a central hinge portion, a first and a second hinge end, and a hinge axis of rotation, the base being configured to collapse around an axis perpendicular to the hinge axis of rotation when the collapsible chair is not occupied but strong enough along the hinge axis of rotation to help prevent planar deformation of the base when the collapsible chair is occupied;

a first adjustment strap connected to a first corner of the base distal to the hinge and connected to a first corner of the back distal to the hinge, wherein the first corners of the base and back distal to the hinge are configured to support the base on a first adjustment strap plane perpendicular to the hinge axis of rotation when the collapsible chair is not rolled up;

a second adjustment strap connected to a second corner of the base distal to the axis and connected to a second corner of the back distal to the axis, wherein the second corners of the base and back distal to the hinge are configured to support the base on a second adjustment strap plane perpendicular to the hinge axis of rotation when the collapsible chair is not rolled up and when the first and second adjustment strap planes are parallel;

a top strap comprising a top strap fastening device, which top strap fastening device may be used to releasably attach the collapsible chair to a luggage;

a side strap comprising a side strap fastening device, which side strap may releasably encircle the luggage;

a first closure along a first perimeter of the base between the first corner of the base distal to the hinge and the first hinge end, along a second perimeter of the back between the first corner of the back distal to the hinge and the first hinge end, along a third perimeter of the base between the first corner of the base distal to the hinge to a middle of a side of the base distal to the hinge, and along a fourth perimeter of the back between the first corner of the back distal to the hinge to a middle of a side of the back distal to the hinge; and a second closure along a fifth perimeter of the base between the second corner of the base distal to the hinge and the second hinge end, along a sixth perimeter of the back between the second corner of the back distal to the hinge and the second hinge end, along a seventh perimeter of the base between the second corner of the base distal to the hinge to the middle of the side of the base distal to the hinge, and along an eighth perimeter of the back between the second corner of the back distal to the hinge to the middle of the side of the back distal to the hinge, wherein the first and second closures may close at least one set of corresponding perimeters of the base and back together, and wherein the collapsible chair is configured as a handbag.

* * * * *